United States Patent [19]

Lewis

[11] Patent Number: 4,503,982

[45] Date of Patent: Mar. 12, 1985

[54] DISPENSER FOR CUP LIDS AND STRAWS

[75] Inventor: Lloyd J. Lewis, Stone Mountain, Ga.

[73] Assignee: Modular Engineering Corporation, Atlanta, Ga.

[21] Appl. No.: 495,762

[22] Filed: May 18, 1983

[51] Int. Cl.[3] ..... A47F 5/00

[52] U.S. Cl. ..... 211/184; 108/61; 211/49.1; 211/135; 211/186; 312/140.4

[58] Field of Search ..... 211/86, 10, 11, 189, 211/135, 184, 49 R, 186; 248/346, 300, 201; 312/183, 140.4, 196; 108/60, 61

[56] References Cited

U.S. PATENT DOCUMENTS

| | | | |
|---|---|---|---|
| 1,267,453 | 5/1918 | Ray | 211/49 R |
| 1,317,589 | 9/1919 | Noziska | 211/11 X |
| 1,677,544 | 7/1928 | Brainard et al. . | |
| 2,142,534 | 1/1939 | Sunderhauf | 211/49 |
| 2,670,853 | 3/1954 | Schneider | 211/49 |
| 2,972,421 | 2/1961 | Frick | 211/184 |
| 3,018,001 | 1/1962 | Combs | 211/49 |
| 3,458,964 | 8/1969 | Guilliams | 248/300 X |
| 3,464,372 | 9/1969 | Fiterman et al. | 108/111 X |
| 3,481,485 | 12/1969 | Hess | 211/134 |
| 3,517,822 | 6/1970 | Wagner | 211/86 X |
| 3,788,487 | 1/1974 | Dawson | 211/49 D |
| 4,109,980 | 8/1978 | Brockman et al. | 211/49 R |

FOREIGN PATENT DOCUMENTS

| | | | |
|---|---|---|---|
| 793646 | 4/1958 | United Kingdom | 211/11 |
| 1019139 | 2/1966 | United Kingdom | 211/187 |

*Primary Examiner*—Robert W. Gibson, Jr.
*Attorney, Agent, or Firm*—Kilpatrick & Cody; Kilpatrick & Cody

[57] ABSTRACT

A dispenser to accommodate, store and display cup lids and straws. A base plate and a cabinet plate form the bottom and side surfaces of the dispenser. Support brackets are adjustably fastened to the base plate, and are shaped to impart to the dispenser a face-up attitude so that the cup lids and straws contained in the dispenser rest against the back restraining surface. Divider sections are fastened to one or more spaced openings in the base plate to separate stacks of lids, and may be easily and quickly repositioned to accommodate changes in sizes and assortments of lids. A straw compartment section may also be fastened to the base plate for orderly storage of straws.

8 Claims, 2 Drawing Figures

DISPENSER FOR CUP LIDS AND STRAWS

BACKGROUND OF THE INVENTION

This invention relates to a dispenser for cup lids and straws which has adjustable storage and dispensing receptacles to accommodate a wide variety of sizes of cup lids and straws.

Restaurants and other establishments serving cold or hot drinks from soda fountains, urns or other sources typically serve these drinks in several sizes of paper or plastic cups. Such establishments also may wish to purchase their cups and lids from different suppliers or manufacturers from time to time, and manufacturers frequently provide cups and lids of sizes different from those of other manufacturers. Further, cups for hot drinks are frequently of material and size different from cups for cold drinks, and require different lids. Thus, those who serve cold or hot drinks must have storage facilities for several sizes of cup lids.

Presently, cup lids are frequently kept stacked on counter tops, or in their shipping containers or boxes. Such a temporary arrangement leads to disorderliness, particularly when customers have access to the lids.

SUMMARY OF THE INVENTION

The dispenser of the present invention includes a base plate serving as the bottom surface of the dispenser and a cabinet plate forming the back and side surfaces. It is constructed of stainless steel or other durable or otherwise appropriate material. A plurality of dividers fastened to spaced openings in the base plate, and which may be quickly and easily repositioned, allow the dispenser to accommodate varying numbers and sizes of lids and straws. The dispenser has adjustably fastened support brackets which allow it to be mounted to many types of mounting surfaces.

It is therefore an object of the present invention to provide a dispenser for cup lids and straws that is durable in nature, that is pleasing in appearance, that adds orderliness to areas in which cold or hot drinks are served, and that easily and readily accommodates changes of lid sizes that may occur over a period of time.

Another object of the present invention is to provide a dispenser for cup lids and straws that allows its supply of lids to be easily visible and easily replenished.

Other objects and advantages of the present invention will become apparent during the course of the following description.

DETAILED DESCRIPTION OF THE DRAWINGS

Figure 1:
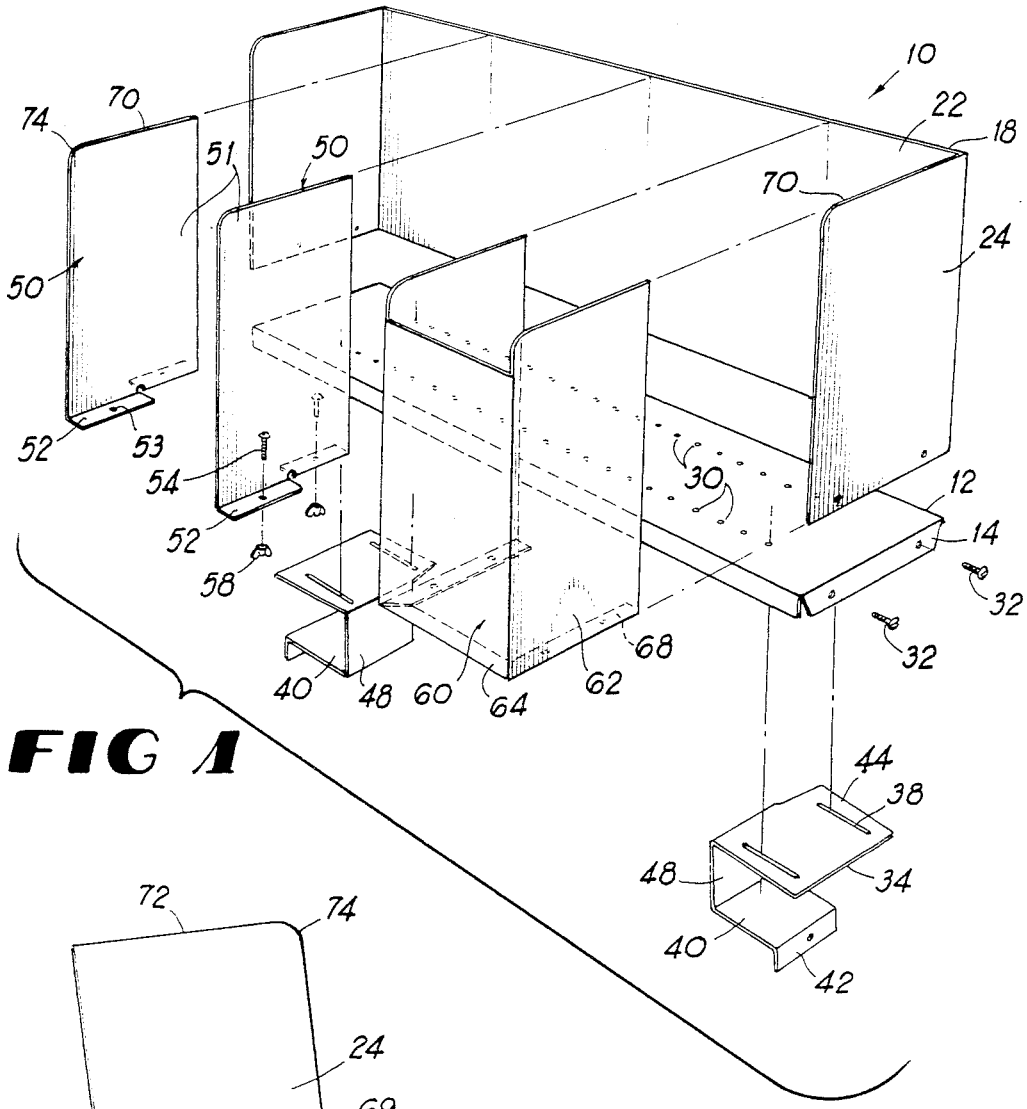
FIG. 1 is an exploded perspective view of one embodiment of the dispenser of the present invention.

With reference to the drawings, FIG. 1 shows the present embodiment of dispenser 10 of the present invention. The components of the present embodiment of dispenser 10 are of stainless steel, although other materials may be utilized, including aluminum, copper, plastic, wood or wood composite material, fiberboard or cardboard. Choice of appropriate materials is determined primarily by durability, cost and aesthetic considerations.

Base plate 12 is the central member of dispenser 10; it supports the lids and straws stored in dispenser 10, and to it are connected the other primary components of dispenser 10. The peripheral portions of base plate 12 may be folded to form skirt tabs 14 depending downwardly from base plate 12, to which may be attached cabinet plate 18, and which imparts to dispenser 10 a pleasing appearance and structural rigidity.

Figure 2:
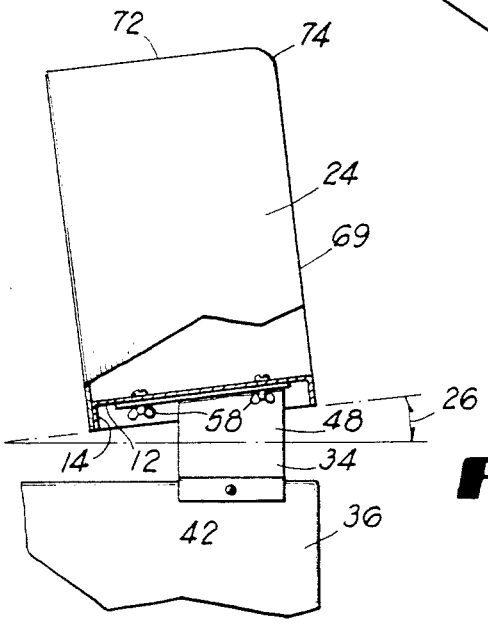
FIG. 2 is a side elevational view of the dispenser shown in FIG. 1.

Cabinet plate 18 comprises two side surfaces 24 and a restraining surface 22 against which straws and stacks of cup lids rest when stored in dispenser 10, as best visualized with reference to FIG. 2. The typically face-up angle of inclination 26 given dispenser 10, discussed more fully below, causes the stored straws and stacked lids to assume a natural gravity-induced repose against restraining surface 22, and thus to resist falling from dispenser 10 while being readily accessible to users.

Formed in base plate 12 are a row or rows of spaced openings 30. These openings receive fasteners 32 which serve to fasten or connect other components of dispenser 10 to base plate 12. In the preferred embodiment, at least two parallel rows of spaced openings 30 are formed in base plate 12 so that components of dispenser 10 may be fastened or connected to base plate 12 at more than one point, thus preventing rotation of these components with respect to base plate 12. Fasteners 32 may be bolts or screws with wingtype or other type nuts, rivets, welding or brazing spots or other type fasteners; in the present embodiment, bolts with wingnuts are used to allow dispenser 10 to be rapidly adapted to new mounting environments and to new and varying cup lid sizes and assortments.

One of the components that may be fastened to dispenser 10 is at least one support bracket 32. In the present embodiment, two support brackets 34 are adjustably fastened to spaced openings 30 and base plate 12 by means of slots 38 that allow support brackets 34 to rotate slightly and to slide with respect to base plate 12 in order to allow dispenser 10 to be mounted to a wide variety of mounting surfaces 36. Support brackets 34 can be fastened to base plate 12 by means of any of spaced openings 30, thus greatly increasing the adaptability of dispenser 10 to a broad range of mounting surfaces 36. Foot plate 40 and toe plate 42 of each support bracket 34 provide surfaces that cooperate with the mounting surface 36 to which dispenser 10 is mounted, and that may be fastened to mounting surface 36. Toe plate 42 may be folded to be coplanar with foot plate 40 or at any other convenient disposition with respect to foot plate 40. Foot plate 40 and toe plate 42 are connected to slot plate 44, in which slots 38 are formed, by angle plate 48.

It is the configuration of angle plate 48 that determines the angle of inclination 26 of dispenser 10, the angle at which base plate 12 is disposed relative to mounting surface 36. In the present embodiment, angle plate 48 is trapezoidal so that slot plate 44 is disposed at angle of inclination 26 relative to toe plate 42 of approximately 7 degrees. Support brackets 34 may be fashioned to vary angle of inclination 26. Typically, angle of inclination 26 is in the range from zero degrees to forty-five degrees, inclusive, and the optimum angle for a given application is dictated by, among other things, the need for ease of access and visibility of the lids and straws stored in dispenser 10.

To the upper surface of base plate 12 may be adjustably fastened any number of divider sections 50, and it is these divider sections 50 that enable dispenser 10 to accommodate numerous sizes of lids in an orderly and aesthetically pleasing fashion by dividing dispenser 10 into at least two compartments 51. The lower portion of each divider section 50 may be fashioned into one or more tangs 52, each of which may have a hole or holes 53 that can be aligned with spaced openings 30 to fasten divider sections 50 to base plate 12. In the present embodiment, divider sections 50 are fastened to base plate 12 by bolts 54 and wing-nuts 58 so that divider sections 50 can be repositioned quickly and easily to accommodate new sizes and new combinations of lids. Two tangs 52 extend in opposite directions from each divider section 50 in the present embodiment to maximize lateral stability of the divider sections when fastened to base plate 12.

One or more straw compartment sections 60 may also be fastened to base plate 12. Each straw compartment section 60 comprises at least one and typically two side plates 62 as well as a face plate 64, to constrain straws stored in dispenser 10. In embodiments where straw compartment section 60 comprises only one side plate 62 and a face plate 64, a side surface 24 of cabinet plate 18 or a divider section 50 may cooperate with straw compartment section 60 to form its third side.

The lower portion of one or more surfaces of straw compartment section 60 may be fashioned into a lip or lips 68, each having a hole or holes 53 that can be aligned with spaced openings 30 in base plate 12 to fasten straw compartment section 60 to base plate 12.

Divider sections 50, side plates 62 of straw compartment section 60, and side surfaces 24 of cabinet plate 18 are so dimensioned that their edges facing the face plane 69 of dispenser 10 lie within that plane, and their edges facing top plane 72 of dispenser 10 also lie within the top plane. They may be chamfered where appropriate, such as at chamfers 74 where their top and face edges meet, to give dispenser 10 a pleasing appearance.

The foregoing description of the present invention is for purposes of explanation and illustration. It will be apparent to those skilled in the relevant art that modifications and changes may be made to the invention as described without departing from the scope and spirit thereof.

I claim:

1. A dispenser for cup lids and straws comprising:
(a) a base plate;
(b) a cabinet plate fastened to the base plate, forming a restraining surface and side surfaces of the dispenser;
(c) at least one support bracket adjustably fastened to the base plate, comprising:
(i) a slot plate having at least one slot formed to cooperate with at least one spaced opening in the base plate for adjustably fastening the support bracket to the base plate;
(ii) a foot plate for fastening the support bracket to a mounting surface; and
(iii) an angle plate connecting the slot plate and foot plate, the angle plate configured to dispose the slot plate and the foot plate at an angle of inclination relative to each other of between zero and forty-five degrees, inclusive; and
(d) at least one divider section adjustably fastened to the base plate to divide the dispenser into at least two lid compartments, and to allow the dispenser to accommodate numerous sizes of lids.

2. A dispenser according to claim 1 further comprising a straw compartment section fastened to the base plate of the dispenser.

3. A dispenser for cup lids and straws, comprising:
(a) a base plate having:
(i) at least one skirt tab depending downwardly; and
(ii) at least one row of spaced openings formed in the base plate;
(b) a cabinet plate fastened to the skirt tabs, forming a restraining surface and two side surfaces of the dispenser;
(c) at least one support bracket adjustably fastened to the base plate, comprising:
(i) a slot plate having at least one slot formed to cooperate with at least one spaced opening for adjustably fastening the support bracket to the base plate;
(ii) a foot plate for fastening the support bracket to a mounting surface; and
(iii) an angle plate connecting the slot plate and foot plate, the angle plate configured to dispose the slot plate and the foot plate at an angle of inclination relative to each other of between zero and forty-five degrees, inclusive;
(d) a plurality of divider sections, each having at least one tang for fastening to at least one spaced opening in the base plate; and
(e) a straw compartment comprising:
(i) at least one side plate;
(ii) a face plate; and
(iii) at least one lip connected to a side plate for fastening to at least one of the spaced openings in the base plate.

4. A dispenser according to claim 3 wherein each of said divider sections is fastened to said base plate by at least one bolt and wing-nut.

5. A kit that may be assembled into a dispenser for cup lids and straws, comprising:
(a) a base plate;
(b) a cabinet plate that may be fastened to the base plate to form a restraining surface and side surfaces of the dispenser;
(c) at least one support bracket that may be fastened to the base plate, comprising:
(i) a slot plate having at least one slot formed to cooperate with at least one spaced opening in the base plate for fastening the support bracket to the base plate;
(ii) a foot plate for fastening the support bracket to a mounting surface; and
(iii) an angle plate connecting the slot plate and the foot plate, the angle plate configured to dispose the slot plate and the foot plate at an angle of inclination relative to each other of between zero and forty-five degrees, inclusive; and
(d) at least one divider section that may be adjustably fastened to the base plate to divide the dispenser into at least two compartments, and to allow the dispenser to accommodate numerous sizes of lids.

6. A kit according to claim 5 further comprising a straw compartment section that may be fastened to the base plate of the dispenser.

7. A kit that may be assembled into a dispenser for cup lids and straws, comprising:
(a) a base plate having:

(i) at least one skirt tab depending downwardly; and (ii) at least one row of spaced openings formed in the base plate;

(b) a cabinet plate that may be fastened to the skirt tabs to form a restraining surface and two side surfaces of the dispenser;

(c) at least one support bracket that may be fastened to the base plate, comprising:

(i) a slot plate having at least one slot formed to cooperate with at least one spaced opening for fastening the support bracket to the base plate;

(ii) a foot plate for fastening the support bracket to a mounting surface; and (iii) an angle plate connecting the slot plate and the foot plate, the angle plate configured to dispose the slot plate and the foot plate at an angle of inclination relative to each other of between zero and forty-five degrees, inclusive;

(d) a plurality of divider sections, each having at least one tang for fastening to at least one spaced opening in the base plate;

(e) a straw compartment section comprising:

(i) at least one side plate;

(ii) a face plate; and (iii) at least one lip connected to a side plate for fastening to at least of the spaced openings in the base plate.

8. A kit according to claim 7 wherein each of said divider sections may be fastened to said base plate by at least one bolt and wing-nut.

* * * * *